US006353393B1

(12) United States Patent
Nylander

(10) Patent No.: US 6,353,393 B1
(45) Date of Patent: Mar. 5, 2002

(54) SWITCH STATUS MONITORING SYSTEM

(75) Inventor: Frederick A. Nylander, Morgan Hill, CA (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/059,836

(22) Filed: Apr. 14, 1998

(51) Int. Cl.[7] ..... G08B 21/00

(52) U.S. Cl. ..... 340/644; 340/545.1; 340/546; 340/508; 340/691.3; 340/650; 340/529

(58) Field of Search ..... 340/545.1, 545.2, 340/546, 547, 506, 507, 508, 650, 651, 652, 529, 691.3, 545.3, 545.4, 545.5, 545.6, 545.7, 545.8, 545.9, 644

(56) References Cited

U.S. PATENT DOCUMENTS 4,365,188 A * 12/1982 Walter ..... 318/282
4,456,908 A * 6/1984 Monroll et al. ..... 340/644
4,647,920 A * 3/1987 Corso ..... 340/650
5,828,302 A * 10/1998 Tsutsumi et al. ..... 340/540
5,844,493 A * 12/1998 Pohl et al. ..... 340/657
6,139,053 A * 10/2000 Knox ..... 280/735

* cited by examiner

*Primary Examiner*—Jeffery Hofsass
*Assistant Examiner*—Daniel Previl
(74) *Attorney, Agent, or Firm*—Wayne J. Egan; Terri S. Hughes

(57) ABSTRACT

A switch status monitoring system (10) includes a switch signal processor (16) that operates in either of a supervised mode or an unsupervised mode for each monitored switch (12). Selection of the operating mode is made via configuration data provided to the switch signal processor, for example, from an applications processor (20). In this manner, reconfiguration of the mode of monitoring, supervised or unsupervised, of any particular switch within a system is accomplished by providing revised configuration data and without changes or modifications to the switch signal processor hardware. As will be appreciated, the present invention has application in for example door or window monitoring systems and in other similar security system applications.

21 Claims, 3 Drawing Sheets

| SW | STATE |
|---|---|
| OPEN | 0 |
| CLOSED | 1 |

| | $V_{IN}$(VOLTS) | OUTPUT |
|---|---|---|
| SHORT | ≈ 0 | 0 |
| OPEN | >$THRESHOLD_C$ | $N_{OPEN}$ |
| ACTIVE (DOOR OPEN) | >$THRESHOLD_A$ | $N_{ACTIVE}$ |
| CLEAR (DOOR CLOSED) | >$THRESHOLD_B$ | $N_{CLEAR}$ |

SWITCH STATUS MONITORING SYSTEM

FIELD OF THE INVENTION

The present invention relates generally to the field of monitoring systems including, but not limited to, a switch status monitoring system arranged for operating in both a supervised mode and an unsupervised mode.

BACKGROUND OF THE INVENTION

In building access control systems it is important to sense the position, open or closed, of the doors monitored by the system. Two approaches to door position monitoring systems are respectively referred to as unsupervised monitoring systems and supervised monitoring systems. Each of the unsupervised monitoring system and the supervised monitoring system use simple, low cost normally open or normally closed switches that change state when the monitored door moves.

An unsupervised door monitoring system has an input representing the two states door open (active) and door closed (clear) as typically provided by an output of a reed switch arranged for opening and closing with the monitored door. Unsupervised door monitoring systems are typically implemented as a digital logic unit. The digital logic unit evaluates the input and provides a digital value (a "1" or "0") corresponding to the door open and door closed states typically to an application processing unit associated with an overall building management system.

A supervised door monitoring system has an input representing typically four or more possible states. Two of the typical four states correspond to the door open (active) and the door closed (clear) states as provided by an associated reed switch. These two states are also often referred to as normal operation. The remaining two states correspond to a short state and an open state. The short state represents a condition where the switch or the wiring connection has developed a short circuit as a result of wiring failure or intentional tampering. The open state represents a condition where the switch or the wiring connection has developed an open circuit. The input in a supervised door monitoring system is an analog electrical signal the magnitude o f which represents at least one of the four possible states. The supervised door monitoring system, therefore, is typically implemented using an analog-to-digital converter or an analog window comparator. The output of either of the analog-to-digital converter or the analog window comparator is typically a count value (ranging from 0 to n counts). The count value, representative of the door status, is provided to an application processing unit associated with an overall building management system or access control unit.

To convert a system implemented as an un supervised door monitoring system to a supervised door monitoring system and vise versa requires not only changing the relatively low cost switch, but also requires changing the associated processing unit. Also, because specialized hardware is required for providing either supervised or unsupervised operation, point-by-point selection of operating modes for particular monitored switch system s is not possible.

Thus, there is a need for an improved door monitoring system that allows flexibility in switch type as well as digital and/or analog or "n" state monitoring.

BRIEF DESCRIPTION OF THE DRAWINGS

Preferred exemplary embodiments of the pre sent invention are illustrated in the accompanying drawings in which like reference numerals re present like parts throughout.

DESCRIPTION OF THE PREFERRED EMBODIMENTS

In accordance with preferred embodiments of the present invention, a switch status monitoring system operates in either of a supervised mode or an unsupervised mode for each monitored door. Selection of the operating mode is made via configuration data provided to the switch status monitoring system—for example, from an applications processor. In this manner reconfiguration of the mode of monitoring, supervised or unsupervised, of any particular switch within a system is accomplished by providing revised configuration data and without changes or modifications to the door processing system hardware. As will be appreciated, the present invention has application in for example door or window monitoring systems and in other similar security system applications. The present invention is generally applicable where it is desirable to monitor in either of a supervised or an unsupervised mode a status signal provided by, for example, a switch.

Figure 1:
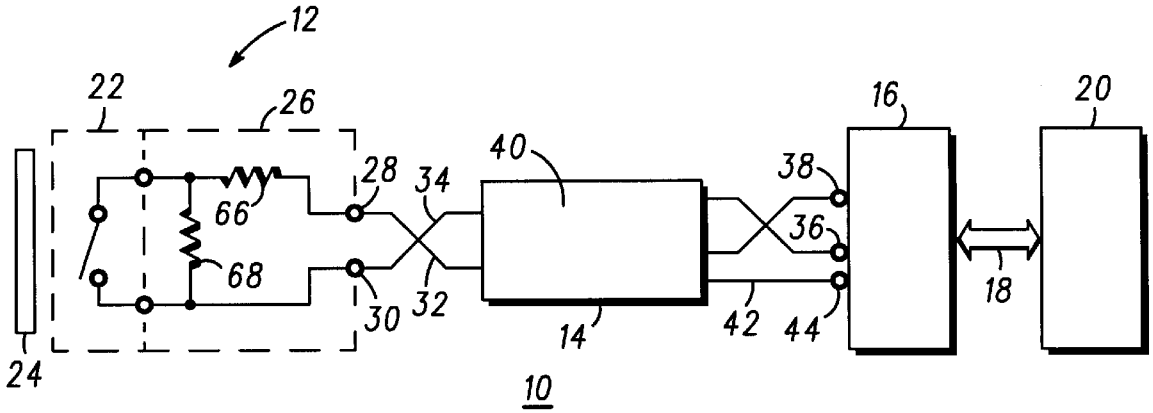
FIG. 1 is schematic illustration of a door position monitoring system in accordance with a preferred embodiment of the present invention.

Referring to the drawings, and particularly to FIG. 1, switch status monitoring system 10 includes at least one switch assembly 12 coupled via a shielded twisted pair electrical cable 14 to a switch signal processor 16. Switch assembly 12 provides a switch signal, open or closed, that is coupled via cable 14 to switch signal processor 16. Switch signal processor 16 is further coupled via a communication bus 18 to an applications processor 20. Switch monitoring system 10 may be adapted to monitor the position of a door or window of a building (not shown), and applications processor 20 may operate, for example, as a security system for providing alarm signals based upon the status of various doors and windows monitored by the system.

In a preferred embodiment, switch 12 comprises a reed contact 22 arranged to open and close in response to magnet 24. For operation in a supervised mode, switch 12 further includes resistor module 26 coupled to reed contact 22. It should be appreciated that resistor module 26 may be made integral to reed contact 22 or may be adapted as an add on module or as individual components. Additionally, it will be appreciated that reed contact 22 may be either of a normally open contact or a normally closed contact. Resistor module includes wire connector 28 and wire connector 30 for respectively coupling to conductor 32 and conductor 34 of cable 14. Conductor 32 and conductor 34 are further coupled to switch signal processor 16 by wire connector 36 and wire connector 38. Cable 14 further includes a shield 40 coupled by conductor 42 to switch signal processor 16 at wire connector 44. While shown as a two-state mechanical switch, one will appreciated that switch 12 may be a multi- or "n" state device. Moreover, switch 12 may also be an electronic device such as a multi-state electronic device.

Figure 2:
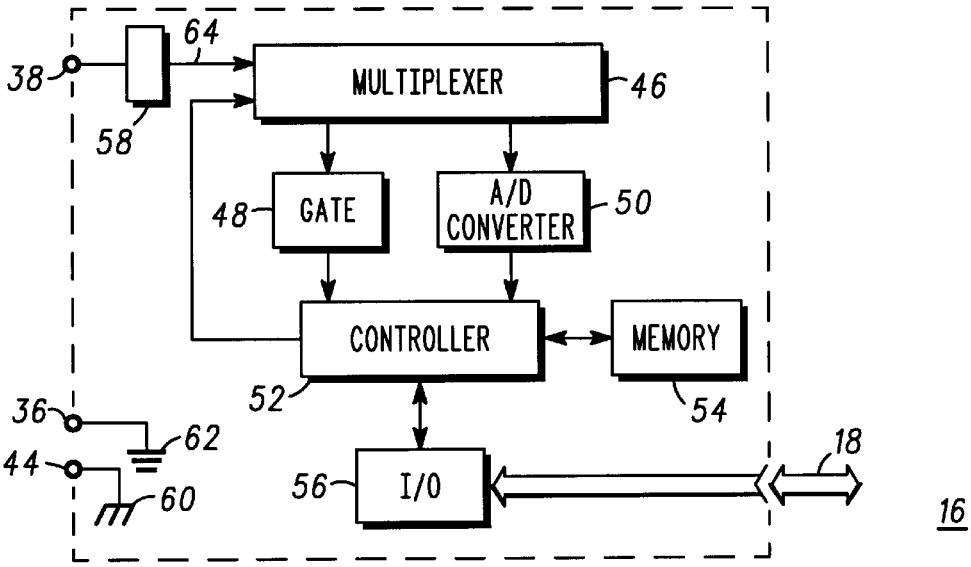
FIG. 2 is a block diagram of a door position signal processor for use in the system shown in FIG. 1.

Referring now to FIG. 2, switch signal processor includes coupled to wire connector 44 shield ground 60 and to wire connector 36 signal ground 62. Coupled to wire connector 38 is a buffer circuit 58. Preferably buffer circuit 58 is a pull-up device providing an input signal 64 responsive to the opening and closing of reed contact 22. Input voltage signal 64 is coupled to multiplexer 46 from which it is selectively coupled in response to a control signal received from controller 52 to a digital gate 48 and an analog-to-digital converter 50. In an alternative arrangement analog-to-digital converter 50 may be an analog window detector. The output of digital gate 48 and the output of analog-to-digital converter are each coupled to controller 52 and from controller 52 to input/output (I/O) controller 56. I/O controller 56 is arranged to couple an output signal from switch signal processor 16 to applications processor 20 via bus 18. Controller 56 is further coupled to memory 54. Memory 54 includes several data structures for storing at least configuration data and threshold settings. In a preferred embodiment of the present invention, switch signal processor may be constructed using a PIC16C73 processor chip available from Microchip Technologies, Inc. Furthermore, while a single switch 12 is shown coupled to switch signal processor 16, it will be appreciated that switch signal processor may be coupled to a plurality of switches. This may be accomplished by utilizing additional wiring connections to switch signal processor 16 and/or using an input multiplexing device.

Briefly, switch signal processor 16 is arranged to include a first operating mode and a second operating mode. In the first operating mode, comprising an unsupervised operating mode, switch signal processor 16 is arranged for evaluating the switch signal as a digital input signal and for providing a digital output value in response thereto, the digital output value representing exactly one state of two possible states comprising an open state and a closed state. Also, in the second operating mode switch, comprising a supervised operating mode, signal processor 16 is arranged for evaluating the switch signal as an analog input signal and for providing a count value (N) in response thereto, the count value representing exactly one state of four possible states comprising a short state, a clear state, an active state and an open state, and the count value being based upon at least one threshold value.

Operation of switch signal processor 16 will now be explained in greater detail with reference to the process 600 illustrated in FIG. 6. When an input signal check is initiated, step 602, switch signal processor 16 first determines whether the particular input being monitored is arranged for supervised monitoring, step 604. This is accomplished by controller 52 referring to the configuration data retained in memory 54. In this regard, for each switch being monitored an entry is made in the configuration data indicating whether the switch is monitored in a supervised or an unsupervised mode.

If the result from step 604 is negative, the switch is being monitored in an unsupervised mode, and multiplexer 46 is arranged to couple input signal 64 to digital gate 48. Switch signal processor then evaluates input signal 64 as a digital signal, step 606. Referring to FIG. 34, if the switch is open, the output of digital gate 48 is "0". If the switch is closed, the output of digital gate 48 is "1". The output of digital gate 48 is then coupled to controller 52 and from controller 52 to I/O controller 56. Switch signal processor 16 then returns to other processing functions, such as evaluating the status of other switches in the system.

If the result from step 604 is positive, the switch is being monitored in a supervised mode, and switch signal processor 16 evaluates input signal 64 as an analog input signal and multiplexer 46 is arranged to couple input signal 64 to analog-to-digital converter 50, step 610. Analog-to-digital converter 50 converts input signal 64 to a count value based on the magnitude of input signal 64. The count value is then communicated to controller 52, which evaluates the count value relative to threshold data stored in memory 54, step 612. The count value is then communicated to I/O controller 56 and is coupled via bus 18 to applications processor 20.

Figures 3, 4, 5:
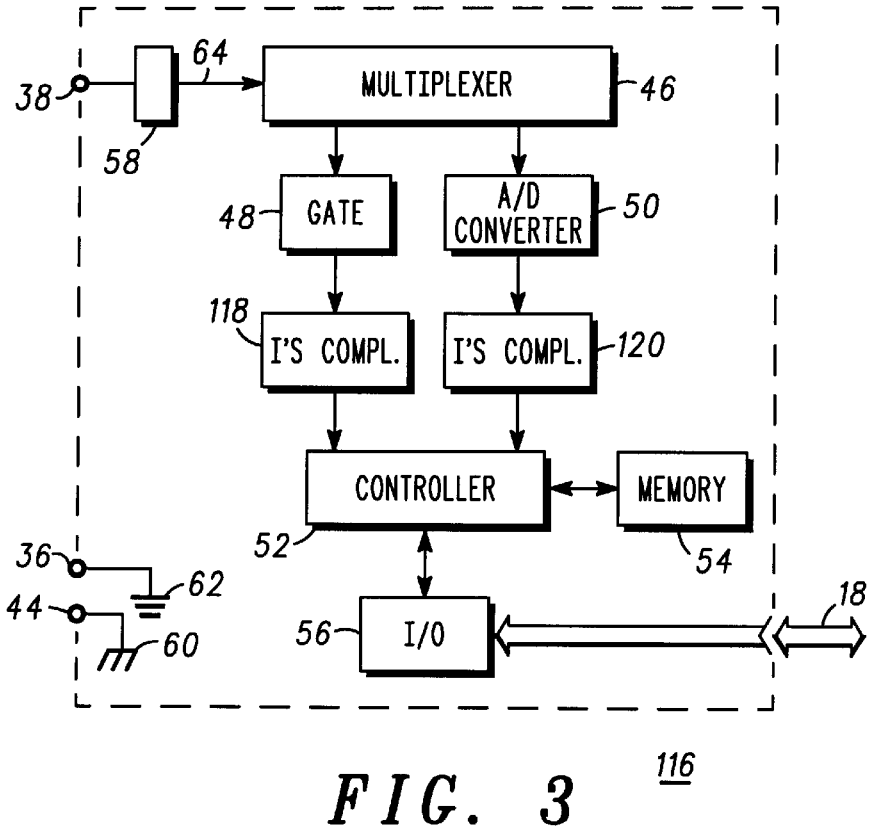
FIG. 3 is a block diagram of a door position signal processor in accordance with an alternative preferred embodiment of the present invention for use in the system shown in FIG. 1.
FIG. 4 is a state table representing a first operating mode of a door position monitoring system in accordance with a preferred embodiment of the present invention.
FIG. 5 is a state table representing a second operating mode of a door position monitoring system in accordance with a preferred embodiment of the present invention.
Figure 6:
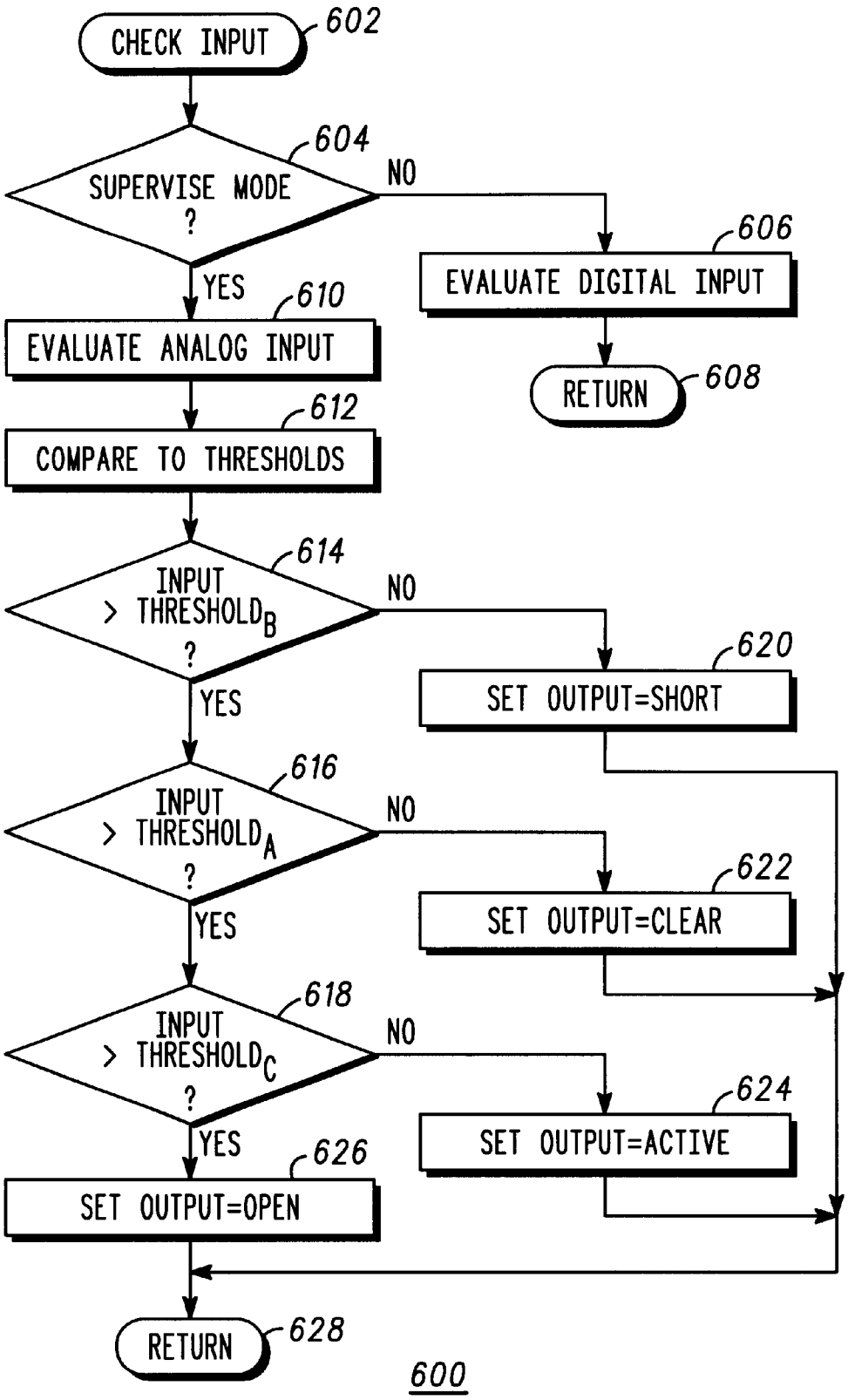
FIG. 6 is a flow diagram illustrating operation of a door position monitoring system in accordance with a preferred embodiment of the present invention.

With reference to FIG. 1, FIG. 5 and FIG. 6, providing there are no short conditions or open conditions between switch 12 and switch signal processor 16, with reed contact 22 open, a current path through switch 12 includes resistor 66 and resistor 68. With reed contact 22 closed, a current path through switch 12 will include only resistor 66. As will be appreciated, input signal 64 will change in magnitude based upon the effective resistance of the current path through switch 12. The output of buffer 58 will therefore be one of two approximate voltage values between 0 and a reference voltage utilized by buffer 58. Should the magnitude of input signal exceed a lower threshold, $\text{Threshold}_B$, but not an upper threshold, $\text{Threshold}_A$, step 614 and step 616, the count value is set to $N_{clear}$, step 622. Should the magnitude of input signal exceed $\text{Threshold}_A$ but not an open threshold, $\text{Threshold}_C$, step 616 and step 618, then the count value is set to $N_{active}$, step 624. If there is a short between switch 12 and switch signal processor 16, then neither resistor 66 nor resistor 68 will be in the current path observed by buffer 58. The output of buffer 58 will therefore by very low, even 0 volts. In this case, the magnitude of the input signal 64 will be below $\text{Threshold}_B$ and near 0, step 614, and the count value is set to 0, step 620. If there is an open between switch 12 and switch signal processor 16, then there will be no current path observed by buffer 58 and its output will be approximately the reference voltage and thus exceeding $\text{Threshold}_C$, step 618. In this case the count value is set to $N_{open}$, step 626. Thus, the count value represents exactly one state of a plurality of possible states of switch 12. At step 628 switch signal processor returns to other processing activities.

In a preferred embodiment of the present invention, the configuration data is updated as the monitored system changes. That is, as new switches are added to the system, as existing switches are reconfigured for supervised or unsupervised operation, or threshold values are revised, the new data is communicated from applications processor 20 to switch signal processor 16 via bus 18. I/O controller 56 receives the update data and communicates it to controller 52 which performs an update operation for retaining the update configuration data and threshold data in memory 54.

With reference to FIG. 3, and alternative switch signal processor 116 is shown. Switch signal processor 116 is configured similar to switch signal processor 16 and includes each of the functional elements shown for switch signal processor 16. Switch signal processor 116 further includes ones complement 118 and ones complement 120 respectively coupled between digital gate 48 and controller 52 and analog-to-digital converter 50 and controller 52. Ones complement 118 and ones complement 120 are arranged to provide an inverse of the output signal from each of digital gate 48 and analog-to-digital converter 50. This is useful where a conversion from normally open switches to normally closed switches is undertaken since the output of the switches will be opposite of the originally configured switches.

In summary, and referring to FIG. 1 and FIG. 2 a switch status monitoring system (10) is arranged to monitor the status of at least one switch (12), the at least one switch providing a switch signal. A signal processor (16) has a first operating mode and a second operating mode. In the first operating mode the signal processor is arranged for evaluating the switch signal as a digital input signal and for providing a digital output value in response thereto. And, in the second operating mode the signal processor is arranged for evaluating the switch signal as an analog input signal and for providing a count value in response thereto. The switch status monitoring system may include an output coupled to an application processor arranged for evaluating the digital output value and the count value.

In an alternative embodiment of the present invention, the switch status monitoring system (10) is arranged as a door position monitoring system including a door position sensor (12) providing a door position signal and a signal processor (16). The signal processor has a first operating mode and a second operating mode. In the first operating mode the signal processor is arranged for evaluating the door position signal as a digital input signal and for providing a digital output value in response thereto. In the second operating mode the signal processor is arranged for evaluating the door position signal as an analog input signal and for providing a count value in response thereto. The door position monitoring system may include an output coupled to an application processor arranged for evaluating the digital output value and the count value.

The switch status monitoring system of the present invention offers a number of advantages over prior art systems.

A first advantage is the ability to have only one type of switch monitoring unit in stock. In a typical access control or alarm monitoring installation, there may be a mix of interior, and exterior zones, as well as points that are to be monitored for maintenance or status functions. In order to monitor these devices, various types of monitoring devices are needed. Some such as exterior zones will need supervised wiring, and interior zones of lesser security impact will not. Having one unit that can fill both needs is advantageous.

A second advantage is flexibility of change from a physical standpoint. As in the discussion of the first advantage above, there are changes in zone boundaries, monitoring points, and other devices that occur during the long lifetime of a building. These changes may be caused by new tenants, moving of interior walls, or expansion of the exterior walls. A previously unsupervised zone may need to have supervision added due to increased security needs. Prior art would require replacement of the monitoring device if it were a device that does not include the dual mode monitoring capacity. In these cases having the flexibility to re-configure the monitored points without having to replace units is an advantage.

A third advantage is flexibility of change from a software standpoint. As the electrical infrastructure of modern building is becoming increasingly computerized, the need for flexibility in changing of set points, monitoring modes is needed from time to time due to the same changes as in B above. In many instances addition or removal of the end of line resistors (66, and 68) is all that is needed to switch between non-supervised to supervised wiring. A switch status monitoring system where the thresholds, and supervision mode of the switch can be changed remotely would save a service call to the site.

A fourth advantage is remote diagnostics. A switch status monitoring system where the digital, count value and comparator status's are available to be processed and transmitted by an application processor, has the ability to be maintained and monitored for proper operation remotely. This remote access would allow more detailed information to be obtained by the service personnel prior to a site visit. This advance information may allow selection of the correct repair materials prior to costly travel to a remote site.

A fifth advantage is remote interrogation. A switch status monitoring system that has the ability to have the raw data, digital value, analog value or window comparator arranged as in the present invention can be interrogated for status from a another device, or location.

A sixth advantage is feature expansion. A switch status monitoring system as in the present invention can have the data available for use by other existing applications or for future applications not related to the security aspects of the present invention. For example the same point may be monitored by a status panel that displays the open/closed status of windows and doors of a facility for use in an energy management application.

A seventh advantage is threshold adjustment. In the present invention the window comparators may be set by the applications processor, even remotely, to make adjustments in the comparator trip points. Prior art where fixed resistor values are employed to set the comparator levels does not have this flexibility. Having this flexibility would allow the switch monitoring device as in the present invention to be adjusted for various end of line resistors, or long wire lengths with much more ease. Prior art would require selection and replacement of resistor values, which would not normally be field replaceable.

An eighth advantage is that a single hardware element is used for both supervised and unsupervised monitoring modes. This arrangement eliminates the need to replace hardware elements in order to convert from an unsupervised mode to a supervised mode and vise versa.

A ninth advantage is the switch status monitoring system of the present invention also allows conversion from a supervised operating mode to an unsupervised monitoring mode and vice versa via downloadable configuration data.

A tenth advantage is the system of the present invention also permits monitoring of virtually any "n" state or multi-state device, including multi-state electronic devices.

One will appreciate that, while the elements of switch signal processor 16, are shown as discrete elements, they may be easily combined. The discrete elements are further intended to represent functional elements. Thus to the degree the function may be otherwise implemented, such as in software or microcode, such an implementation does not depart from the fair scope of the present invention. Many other changes and modifications could be made to the present invention without departing from the fair scope and spirit thereof.

I claim:

1. A switch status monitoring system including a signal processor coupled to at least one switch, the at least one switch providing a switch signal, the signal processor providing a first operating mode and a second operating mode, wherein the first operating mode comprises an unsupervised operating mode, and the second operating mode comprises a supervised operating mode, in the first operating mode, the signal processor arranged for evaluating the switch signal as a digital input signal and for providing a digital output value in response thereto, and in the second operating mode, the signal processor arranged for evaluating the switch signal as an analog input signal and for providing a count value in response thereto.

2. The switch status monitoring system of claim 1, comprising an application processor arranged for evaluating the digital output value and the count value.

3. The switch status monitoring system of claim 1, the signal processor including configuration data, the signal processor operating in one of the first operating mode and the second operating mode based upon the configuration data.

4. The switch status monitoring system of claim 3, comprising an application processor arranged to communicate the configuration data to the signal processor.

5. The switch status monitoring system of claim 1, the signal processor in the second operating mode arranged to convert the switch signal to a count value and the count value being based upon at least on threshold value.

6. The switch status monitoring system of claim 1, the signal processor arranged to provide a ones complement of each of the digital output value and the count value.

7. The switch status monitoring system of claim 1, the count value representing exactly one state of a plurality of possible states.

8. The switch status monitoring system of claim 1, the count value representing exactly one state of four possible states comprising a short state, a clear state, an active state and an open state.

9. The switch status monitoring system of claim 1, the digital output value representing exactly one state of two possible states comprising an open state and a closed state.

10. The switch status monitoring system of claim 1, the at least one switch arranged for monitoring a position of one of a door and a window.

11. The switch status monitoring system of claim 1, the at least one switch comprising a multi-state device.

12. A switch status monitoring system arranged to monitor a status of at least one switch, the at least one switch providing a switch signal, and a signal processor providing a first operating mode and a second operating mode, wherein the first operating mode comprises an unsupervised operating mode, and the second operating mode comprises a supervised operating mode, in the first operating mode, the signal processor arranged for evaluating the switch signal as a digital input signal and for providing a digital output value in response thereto, in the second operating mode, the signal processor arranged for evaluating the switch signal as an analog input signal and for providing a count value in response thereto, and an applications processor coupled to the switch status monitoring system to receive the digital output value and the count value and arranged to operate on the digital output value and the count value.

13. A door position monitoring system comprising:

a door position sensor providing a door position signal, and a signal processor providing a first operating mode and a second operating mode, wherein the first operating mode comprises an unsupervised operating mode, and the second operating mode comprises a supervised operating mode, in the first operating mode, the signal processor arranged for evaluating the door position signal as a digital input signal and for providing a digital output value in response thereto, and in the second operating mode, the signal processor arranged for evaluating the door position signal as an analog input signal and for providing a count value in response thereto.

14. The door position monitoring system of claim 13, comprising an application processor arranged for evaluating the digital output value and the count value.

15. The door position monitoring system of claim 13, the signal processor including configuration data, the signal processor operating in one of the first operating mode and the second operating mode based upon the configuration data.

16. The door position monitoring system of claim 15, comprising an application processor arranged to communicate the configuration data to the signal processor.

17. The door position monitoring system of claim 13, the signal processor in the second operating mode arranged to convert the door position signal to a count value and the count value being based on at least one threshold value.

18. The door position monitoring system of claim 13, signal processor arranged to provide a ones complement of each of the digital output value and the count value.

19. The door position monitoring system of claim 13, the count value representing exactly one state of a plurality of possible states.

20. The door position monitoring system of claim 13, the count value representing exactly one state of four possible states comprising a short state, a clear state, an active state and an open state.

21. The door position monitoring system of claim 13, the digital output value representing exactly one state of two possible states comprising an open state and a closed state.

* * * * *

UNITED STATES PATENT AND TRADEMARK OFFICE

CERTIFICATE OF CORRECTION

PATENT NO. : 6,353,393 B1
DATED : July 24, 2002
INVENTOR(S) : Frederick A. Nylander It is certified that error appears in the above-identified patent and that said Letters Patent is hereby corrected as shown below:

Column 7,
Line 18, change "on" to -- one --

Signed and Sealed this

Nineteenth Day of November, 2002

*Attest:*

*Attesting Officer*

JAMES E. ROGAN
*Director of the United States Patent and Trademark Office*